US006012506A

United States Patent [19]

Wang et al.

[11] Patent Number: 6,012,506

[45] Date of Patent: Jan. 11, 2000

[54] VENETIAN BLIND PROVIDED WITH SLAT-LIFTING MECHANISM HAVING CONSTANT FORCE EQUILIBRIUM

[75] Inventors: Wei-Cheng Wang, Tai Nan Hsien; Chen-Chin Cheng, Hsin Chu; Fu-Jen Hu Kao, Taipei; Ya-Wei Hsu, Hsin Chu, all of Taiwan

[73] Assignees: Industrial Technology Research Institute, Hsinchu; Nien Enterprise Co., Ltd., Chang Hua Hsien, both of Taiwan

[21] Appl. No.: 09/224,952

[22] Filed: Jan. 4, 1999

[51] Int. Cl.[7] ..... E06B 9/30

[52] U.S. Cl. ..... 160/170; 160/192

[58] Field of Search ..... 160/170 R, 171 R, 160/168.1 R, 172 R, 84.04, 191, 192, 193; 267/155, 156; 185/37, 39, 45

[56] References Cited

U.S. PATENT DOCUMENTS 5,133,399 7/1992 Hiller et al. ..... 160/170 R X 5,170,830 12/1992 Coslett ..... 160/84.04

5,482,100 1/1996 Kuhar ..... 160/170 R 5,531,257 7/1996 Kuhar ..... 160/170 R X

*Primary Examiner*—David M. Purol

*Attorney, Agent, or Firm*—Browdy and Neimark

[57] ABSTRACT

A Venetian blind is provided with a slat-lifting mechanism consisting of a slat set, a slat pull cord, and a constant torque pull set. The slat set has a plurality of slats. The slat pull cord is connected with each of the slats of the slat set and is put through the bottommost end of the slat set. The constant torque pull set is disposed at the top end of the slat set and composed of a pull cord member and a constant torque spring unit which is linked with the pull cord member and provided with a constant torque spring which has a constant retrieving force enabling the pull cord member to rewind. The constant retrieving force of the constant torque spring must meet the condition of W−Fs<R<W+Fs, in which W stands for a total weight of the slat set; Fs, a system static friction force; and R, a retrievable elastic force of the constant torque spring.

7 Claims, 3 Drawing Sheets

VENETIAN BLIND PROVIDED WITH SLAT-LIFTING MECHANISM HAVING CONSTANT FORCE EQUILIBRIUM

FIELD OF THE INVENTION

The present invention relates generally to a slat-lifting mechanism of the Venetian blind, and more particularly to the slat-lifting mechanism having a constant force equilibrium.

BACKGROUND OF THE INVENTION

The conventional Venetian blind consists of a slat-lifting mechanism having an outer pull rod, a slat set pull cord and a ratchet member. The outer pull cord is so exposed as to facilitate the pulling of the outer pull cord with hand. The slat set pull cord is connected with the slat set and linked with the outer pull cord for controlling the ascending and the descending of the slat set. In the meantime, the ratchet member is driven by the slat set pull cord to remain in an engaging state or a disengaging state, so as to locate the slat set at a desired position.

The exposed outer pull cord of the slat-lifting mechanism of the prior art is a potential safety hazard in view of the fact that a playful child may be accidentally strangled by the exposed outer pull cord. In addition, the exposed outer pull cord is prone to becoming entangled with the slat set.

SUMMARY OF THE INVENTION

It is therefore the primary objective of the present invention to provide the Venetian blind with a slat-lifting mechanism without an exposed pull cord, so as to eliminate the safety hazard.

It is another objective of the present invention to provide the Venetian blind with a slat-lifting mechanism which is free from an exposed pull cord and is simple in construction.

In keeping with the principle of the present invention, the foregoing objectives of the present invention are attained by the slat-lifting mechanism consisting of a slat set, a slat pull cord, and a constant torque pull set. The slat set has a plurality of slats. The slat pull cord is connected with each of the slats of the slat set and is put through the bottommost end of the slat set. The constant torque pull set is disposed at the top end of the slat set and composed of a pull cord member and a constant torque spring unit which is linked with the pull cord member and provided with a constant torque spring. The spring has a constant retrieving force enabling the pull cord member to rewind. The constant retrieving force of the constant torque spring must meet the following condition:

$$W-Fs<R<W+Fs,$$

in which

W stands for a total weight of the slat set;

Fs, a system static friction force; and

R, a retrievable elastic force of the constant torque spring.

The foregoing objectives, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
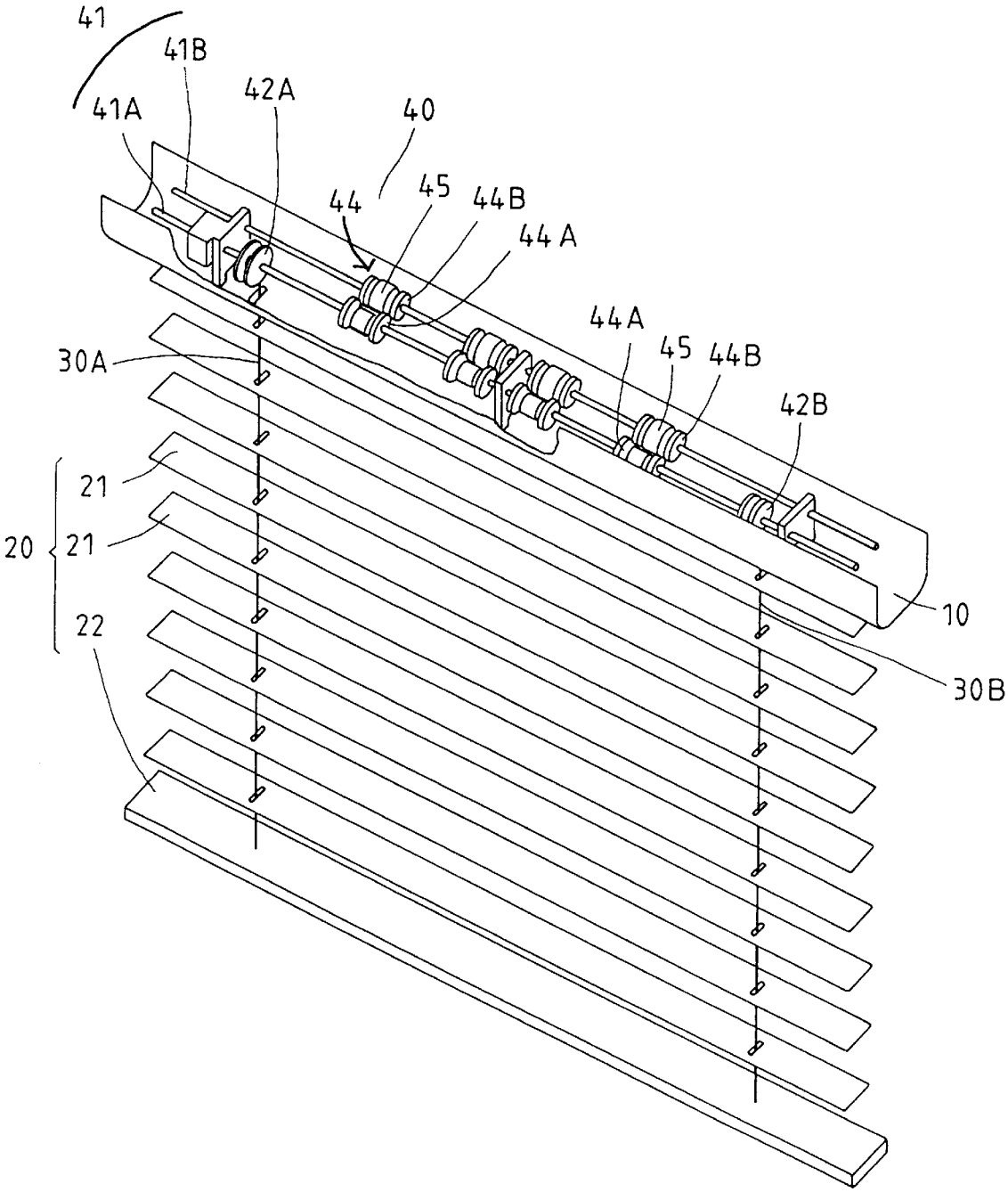
FIG. 1 shows a perspective view of the present invention.

As shown in FIG. 1, the present invention has a frame 10, a slat set 20, slat pull cords, and a constant torque pull set 40.

The frame 10 is disposed at the top of a Venetian blind and fastened with a window.

The slat set 20 has a plurality of slats 21, and a bottom plate 22 located at the bottommost part thereof. The slat set 20 has a total weight W.

The slat pull cords has two pull cords 30A and 30B, which are fastened respectively at one end thereof with the constant torque set 40 such that other end thereof is put through each slat 21 of the slat set 20 before being fastened with the bottom plate 22.

Figure 2:
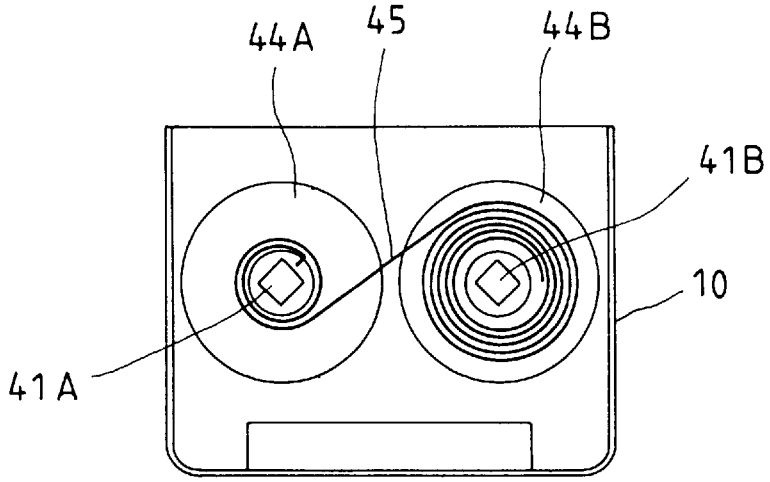
FIG. 2 is a sectional view taken along the direction indicated by a line 2—2 as shown in FIG. 1, for showing a schematic view of the constant torque spring unit.

The constant torque pull set 40 is disposed in the frame 10 and composed of a pull cord member 41 having a first spindle 41A and a second spindle 41B. The first spindle 41A is provided with two winding wheels 42A and 42B for winding the pull cords 30A and 30B. the first spindle 41A is capable of turning, whereas the second spindle 41B is fixed. Now referring to FIG. 2, a constant torque spring unit 44 has at least two rolling wheels 44A and 44B opposite to 44A, which are mounted on the first and the second spindles 41A and 41B. Located between the two rolling wheels 44A and 44B is a constant torque spring 45, which is fastened at one end thereof with the rolling wheel 44A such that other end thereof is freely disposed on the rolling wheel 44B. In order words, the spring 45 has a fixed end and a storage end in a free state. The spring 45 is capable of providing a constant elastic force at any winding position. As a result, the rolling wheels 44A and 44B are provided with a constant rewinding force. In other words, the pull cord member 41 is provided with a constant rewinding force. The constant retrievable force of the constant torque spring 45 must meet the following condition:

$$W-Fs<R<W+Fs,$$

in which

W stands for a total weight of the slat set;

Fs, a system static friction force; and

R, a constant retrievable elastic force of the constant torque spring.

In other words, W−Fs denotes a force causing the slat set to descend in light of the total weight of the slat set. W+Fs denotes a force causing the slat set to ascend in light of the constant retrievable elastic force of the constant torque spring. When the constant retrievable force of the constant torque spring meets the above condition, the slat set remains in a static equilibrium, which means that the slat set is kept at a constant level. If the slat set is to be raised or lowered, the static equilibrium must be upset by an external force. As the external force is rid of, the static equilibrium of the slat set is restored.

Figure 3:
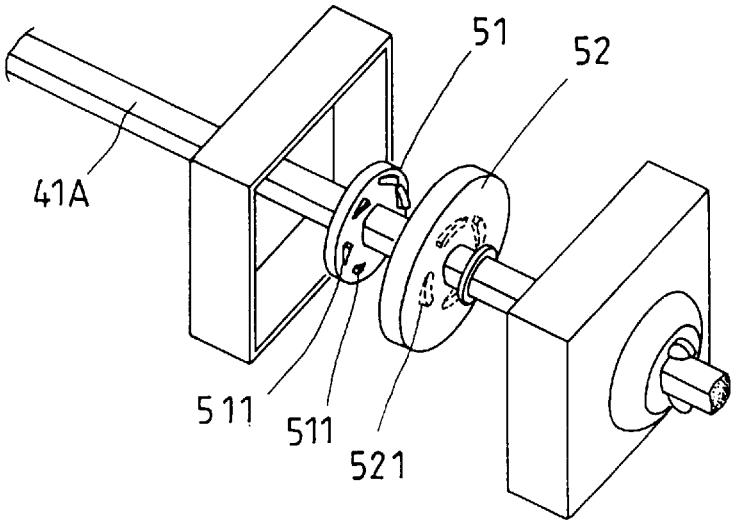
FIG. 3 shows an exploded view of a friction force adjuster of the present invention.

As shown in FIG. 3, the present invention is additionally provided with a friction adjuster 50 in light of the length of a window. Under the circumstance that the constant retrievable elastic force of the constant torque spring 45 remains in its restriction condition, the system static friction force can be so modulated that the entire system is kept in the static equilibrium. The friction adjuster 50 has two disks 51 and 52, which are mounted on the first spindle 41A of the pull cord member 41 and are provided with protrusions 511, 521. The protrusions 511 and 521 are in contact with each other to bring about a predetermined friction resistance. The number of the friction adjusters 50 used is dependent on the weight of the slat set.

The slat pull cords 30A and 30B are arranged unidirectionally. However, the slat pull cords may also be arranged in a loop-type manner wherein the slat pull cords are put downward through the slat set 20 to reach the bottom plate 22 before the slat pull cords are put horizontally through the bottom plate 22 and then upward through the slat set 20 to reach the frame 10.

Figure 4:
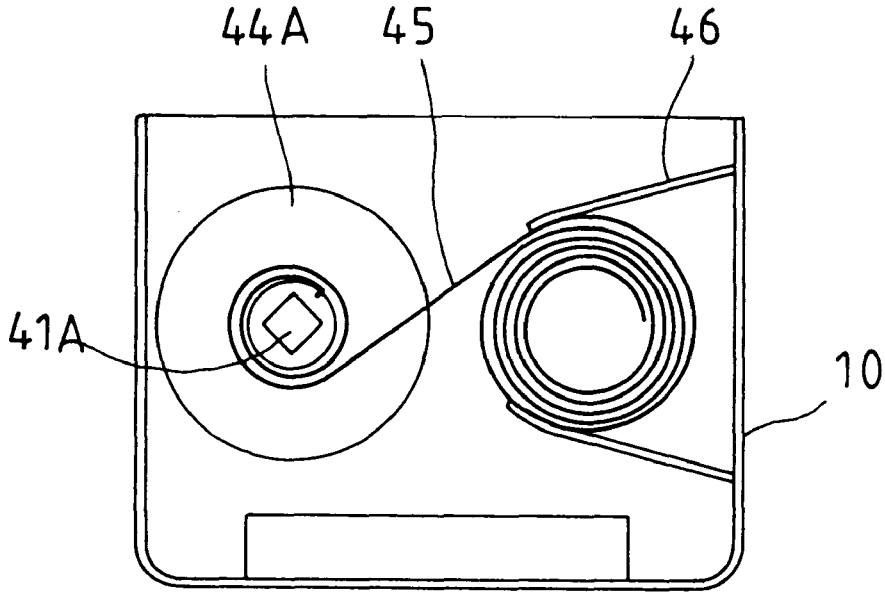
FIG. 4 shows a schematic view of a constant torque spring unit of another preferred embodiment of the present invention.

As shown in FIG. 4, the constant torque spring 45 of another preferred embodiment of the present invention is fastened at one end thereof with the rolling wheel 44A of the first spindle 41A such that other end thereof confines the position of the constant torque spring 45 by means of two arresting pieces 46, thereby keeping the storage end of the constant torque spring 45 in the free state. In other words, the constant torque spring 45 may not be disposed on the second spindle 41B. such a modification in design of the present invention as described above must be deemed as the spirit of the present invention. The present invention is therefore to be limited only by the scopes of the following appended claims.

What is claimed is:

1. A Venetian blind provided with a slat-lifting mechanism having a constant force equilibrium, said mechanism comprising a slat set, a slat pull cord, and a constant torque pull set; wherein said slat set has a plurality of slats; wherein said slat pull cord is connected with each of said slats of said slat set and put through a bottommost end of said slat set; and wherein said constant torque pull set is disposed at a top end of said slat set and composed of a pull cord member and a constant torque spring unit, said pull cord member being intended for winding said slat pull cord and linked with said constant torque spring unit, said constant torque spring unit having a constant torque spring which is provided with a constant retrievable elastic force enabling said pull cord member to have a rewinding force, said constant retrievable elastic force meeting a requirement expressed as follows:

$$W-F_s<R<W+F_s,$$

in which

W stands for a total weight of said slat set;

$F_s$, a system static friction force; and

R, a retrievable elastic force of the said constant torque spring;

said mechanism further comprising a friction adjuster for modulating a friction force value of the mechanism, wherein said friction adjuster is provided with two disks which are mounted on said first spindle and provided respectively with a plurality of protrusions in contact with one another.

2. The mechanism as defined in claim 1, wherein said pull cord member has a first spindle provided with two winding wheels for winding said slat pull cord.

3. The mechanism as defined in claim 2, wherein said constant torque spring is fastened at one end thereof with said first spindle such that other end of said constant torque spring remains in a free state.

4. The mechanism as defined in claim 3, wherein said free end of said constant torque spring is provided in an outer periphery thereof with two arresting pieces for confining position of said constant torque spring.

5. The mechanism as defined in claim 3, wherein said first spindle is further provided with a rolling wheel for fastening a fixed end of said constant torque spring.

6. The mechanism as defined in claim 3, wherein said free end of said constant torque spring is provided with a second spindle.

7. The mechanism as defined in claim 6, wherein said second spindle is provided with a rolling wheel mounted thereon for fastening said free end of said constant torque spring.

* * * * *